United States Patent [19]

Gebhart

[11] 4,142,336

[45] Mar. 6, 1979

[54] EARTH ANCHOR

[75] Inventor: Carlton E. Gebhart, La Grange Park, Ill.

[73] Assignee: Joslyn Mfg. and Supply Co., Chicago, Ill.

[21] Appl. No.: 834,174

[22] Filed: Sep. 19, 1977

[51] Int. Cl.[2] ..... E02D 5/74

[52] U.S. Cl. ..... 52/166

[58] Field of Search ..... 52/166, 165, 733, 735; 61/39, 53-62

[56] References Cited

U.S. PATENT DOCUMENTS

| | | | |
|---|---|---|---|
| 1,746,848 | 2/1930 | Bates | 52/166 |
| 3,250,075 | 5/1966 | Webb et al. | 52/166 X |
| 3,742,717 | 7/1973 | Wey | 61/53.62 X |
| 3,971,177 | 7/1976 | Endo | 52/166 |

FOREIGN PATENT DOCUMENTS

| | | | |
|---|---|---|---|
| 1019520 | 1/1953 | France | 52/166 |

*Primary Examiner*—Price C. Faw, Jr.
*Assistant Examiner*—Carl D. Friedman
*Attorney, Agent, or Firm*—Mason, Kolehmainen, Rathburn & Wyss

[57] ABSTRACT

An improved grouted earth anchor having a modified end configuration that reduces undesirable tensile stress in the grout ball. The reduction in tensile stress is accomplished by locating the enlarged end section of the end configuration of the anchor rod away from the bottom of the grout ball, and by shaping the enlarged end section in a predetermined manner in order to make the compressive stress trajectories between the surface of the enlarged end section and the surface of the grout ball as straight as possible.

24 Claims, 5 Drawing Figures

16
32
36
34
24
22

26
12
10
3
14
30
16
A
3
28
18
20

12
B
14
32a
36a
34a
16a
18
C
32b
36b
34b
16b
20
28

12
14
18
16
32
36
34
20
28

44
46
40
42
14
18

EARTH ANCHOR

BACKGROUND OF THE INVENTION

1. Field of the Invention

This invention relates generally to earth anchors, and more particularly, to explosive or belled grouted anchors suitable for anchoring a structure to the ground.

2. Description of the Prior Art

Explosive or Malone anchors, and belled anchors, are known. Such anchors generally comprise an elongated rod or shank having an end configuration which may comprise an integrally formed enlarged end section or an end section formed from a washer and nut screwed onto the rod or shank. Such anchors are generally anchored to the ground by drilling a hole in the ground and setting off an explosive charge at the bottom of the drilled hole. The resultant explosion compresses the earth and forms an enlarged chamber at the bottom of the drilled hole. Alternatively, the chamber may be formed by an expandable drill, such as a belling tool, that is expandable at the bottom end and drills out the chamber. The chamber is then filled with grout through a tube to prevent the grout from being contaminated by foreign matter. The anchor rod is inserted into the drilled hole, and positioned so that the enlarged end section of the anchor rod contacts the bottom of the chamber. The drilled hole is then completely filled with grout. The grout is allowed to harden, and the grout ball thus formed inside the chamber serves to retain the anchor in the ground.

While such anchors are satisfactory for many purposes, in the prior art anchors, no attempt has been made to optimize the shape of the end configuration and its position within the grout ball in order to optimize the transfer of forces from the end configuration through the grout ball and into the soil, while minimizing undesirable tensile stresses within the grout ball. In such prior art anchors, the compressive stress trajectories or lines of force that extend between the surfaces of the end configuration and the soil resisting surface of the grout ball are curved. The compressive stress trajectories are curved because they must intersect the surfaces of the end configuration and the soil resisting surface of the grout ball at 90° angles; and since the end of a stress trajectory intersecting the surface of the end configuration is normally not colinear with the end of the stress trajectory intersecting the surface of the grout ball, the portion of the stress trajectory interconnecting the non-colinear ends must be curved. Such curved trajectories cause shear stresses within the grout ball which result in tensile stresses that cause the grout ball to crack prematurely. Also, when as in the prior art anchors, the end configuration is located in the lower half of the grout ball where there is little or no lateral resistance from the soil, the ball is more prone to splitting due to tensile stresses generated in the region of the end configuration.

SUMMARY OF THE INVENTION

Accordingly, it is an object of the present invention to provide an improved grouted anchor that overcomes many of the disadvantages of the prior art anchors.

It is another object of the present invention to provide an improved grouted anchor that minimizes the tendency of the grout ball to crack.

It is another object of the present invention to provide a grouted anchor that reduces undesirable tensile stress within the grout ball.

It is yet another object of the present invention to provide an improved grouted anchor that generates straighter and more optimum compressive stress trajectories within the grout ball than those generated by the prior art anchors.

In accordance with a preferred embodiment of the invention, an improved grouted anchor has a rod shank and an end configuration having a more nearly optimally shaped enlarged end section located in a more nearly optimum location within the grout ball. The surfaces of the end configuration are designed so that lines perpendicular to the surfaces of the end configuration are more nearly colinear with lines perpendicular to the soil resisting surfaces of the grout ball thereby to provide more nearly straight compressive stress trajectories within the grout ball. Also, the enlarged section or sections of the end configuration are spaced away from the bottom of the grout ball further to reduce tensile stresses generated in the region of the end configuration.

More specifically, the enlarged section of the end configuration is approximately centrally located within the grout ball when an end configuration having a single enlarged section is used. When an end configuration having two enlarged sections is used, the enlarged sections are each spaced away from the center of the grout ball by an amount approximately equal to one-sixth of the diameter of the grout ball. Thus, the two enlarged sections are spaced apart by a distance approximately equal to one-third of the height of the grout ball, with the upper and lower enlarged sections also being spaced from the respective upper and lower surfaces of the grout ball by approximately one-third the height of the grout ball along the axis of the rod. Such a positioning of the end configuration within the grout ball together with the more nearly optimum shape of the upper surface or surfaces of the end configuration generates substantially straighter compressive stress trajectories between the enlarged sections of the end configurations and the soil resisting surface of the grout ball, thus substantially reducing the tendency of the grout ball to crack prematurely.

The enlarged section or sections forming the end configuration may be threadingly fixed to the rod shank to permit adjustment of the relative position of the enlarged section or sections and the rod shank. This permits the enlarged section or sections to be positioned at the optimum position for grout balls of various sizes.

These and other objects and advantages of the present invention will be readily understood by reference to the following detailed description and attached drawing wherein.

DETAILED DESCRIPTION OF THE PREFERRED EMBODIMENT

Figures 1, 2, 3, 4, 5:
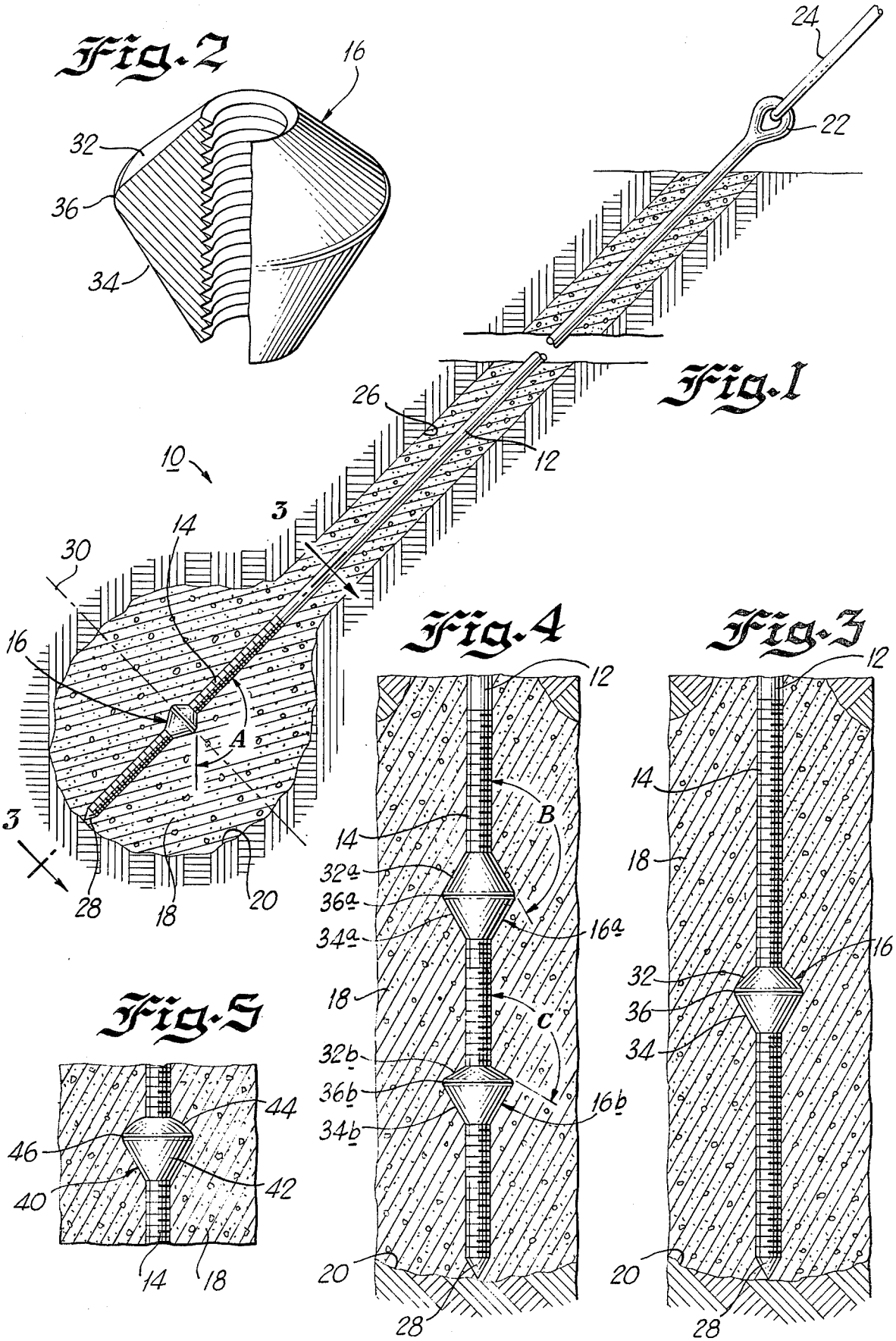
FIG. 1 is a side sectional view of an earth anchor according to the present invention shown imbedded within the earth.
FIG. 2 is a perspective view, partially in cross-section showing the details of an enlarged section of the anchor rod according to the invention.
FIG. 3 is a fragmentary sectional view of the anchor according to the invention taken along line 3—3 of FIG. 1.
FIG. 4 is a fragmentary sectional view similar to FIG. 3 showing a dual enlarged section embodiment of the anchor according to the invention.
FIG. 5 is a fragmentary sectional view similar to FIGS. 3 and 4 showing an alternative configuration for the enlarged section.

Referring now to the drawing, with particular attention to FIG. 1, there is shown a preferred embodiment of the anchor according to the invention, generally designated by the reference numeral 10. The anchor 10 comprises a rod or shank 12 having a threaded end section 14 and an enlarged section 16 threadingly affixed to the end section 14. The anchor 10 is secured within the earth by a grout ball that fills a chamber in the earth that has been explosively formed or drilled out with a belling tool or other drill having an expandable end section. An eye 22 or the like is affixed to the opposite end of the shank 12 to permit the anchor rod to be attached to the structure being supported by a rod, such as the rod 24, a guy wire, or other device. The anchor 10 is illustrated in an inclined position, since such anchors may be used to support a tower, such as a radio tower, by means of guy wires. In such instances, the anchor 10 is positioned colinearly with the guy wire to minimize the bending moments applied to the anchor 10.

When an anchor of the type illustrated in FIG. 1 is used, a hole 26 is first drilled into the earth in a direction colinear with the direction of the guy wire to be attached. An explosive charge is then dropped into the bottom of the hole 26, the hole plugged with a suitable material to contain the explosive and the charge detonated. The detonation causes a localized compacting of the earth, and results in formation of the chamber 20. Alternatively, the chamber 20 may be mechanically drilled out by means of a drill, such as a belling tool, having an expandable end. Such a mechanical drilling out of the chamber 20 is particularly advantageous in relatively incompressible soils that are difficult to compact with explosive charges.

The chamber 20 is then filled with grout, preferably through a tube to minimize dirt contamination of the grout during the filling process, and the shank 12 and the enlarged section 16 are inserted through the drilled hole 26 and into the grout within the chamber 20. The remainder of the chamber 20 (if not completely filled previously) and the drilled hole 26 are then completely filled with grout, and the grout is allowed to harden. Typically, the grout used is made from a mixture of sand and cement mixed with water; however, other substances may be added or substituted, as required. For purposes of this discussion, the term grout shall mean any substance that may be poured into the chamber 20 in a liquid or slurry form, and which hardens to secure the anchor rod within the ground.

As can be seen from the drawing, the enlarged end section 16 (FIG. 1) is approximately centrally located within the chamber 20 when a single enlarged section is employed. The reason for locating the enlarged section 16 centrally is that when an anchor is positioned as shown, and tension is applied to the rod 24, the only force retaining the anchor 10 in place is generated by a soil resisting portion of the grout ball 18 above a center line 30. This occurs because the soil resisting portion of the grout ball 18 above the line 30 generates a compressive force on the soil when tension is applied to the rod 24. The portion of the grout ball below the line 30 exerts no restraining force since the tension applied to the line 24 separates the ball from the soil. For purposes of this discussion, the terms above and below shall mean toward or away from the soil resisting portion of the grout ball, respectively, in a direction along the axis of the shank 12, regardless of the orientation of the anchor 10.

The compressive stress trajectories extend outwardly from the upper surface of the enlarged section 16 in a direction perpendicular to that surface. The stress trajectories extend through the grout ball and intersect the portion of the surface of the grout ball above the line 30 at a 90° angle. By appropriately shaping the upper surface of the enlarged section 16 and locating the enlarged section 16 near the center of the grout ball 18 as shown, the ends of the stress trajectories extending from the enlarged section 16 can be made substantially colinear with the ends of the respective stress trajectories intersecting the surfaces of the grout ball 18. The two colinear ends of each stress trajectory can be joined by a substantially straight line, thus resulting in substantially straight stress trajectories between the enlarged section 16 and the upper surface of the grout ball 18. This is in contrast to the prior art systems wherein the enlarged section 16 is located near the bottom of the grout ball. Such a placement of the enlarged section 16 results in long curved compressive stress trajectories between the enlarged section 16 and the upper portion of the ball 18, and puts a greater stress on the grout ball 18.

In order further to reduce the stress applied to the grout ball 18, the shape of the upper surface section 16 is designed so that lines extending perpendicular to the upper surface of the section 16 are substantially colinear with the lines extending perpendicular to the upper surface of the grout ball 18. This is accomplished in the embodiment illustrated in FIG. 1 by providing the enlarged section 16 with upper conical section 32 (best illustrated in FIG. 2) and by selecting the angle between the upper conical surface 32 and the axis of the rod shank 12, designated as A, to provide the most nearly straight compressive stress trajectories. The angle A has been found to be relatively critical, and is dependent on the position of the enlarged section 16 within the grout ball 18. Typically, best results have been obtained when the angle A is in the range of 110° to 160°, with an angle in the range of 125° to 145°, preferably 135°, being optimal for a centrally located enlarged section. An angle of 135° is illustrated in the drawing. If the enlarged section 16 is located nearer the bottom of the grout ball, the optimum value for the angle A is nearer to 110°. If the enlarged section 16 is positioned nearer the upper surface of the ball 18, the optimum value of the angle A is nearer to the 160° end of the range.

The angle of the conical section 34 is not critical, because the main purpose of the conical section 34 is to permit the anchor to be easily inserted into the grout within the chamber. For similar reasons, the end 28 of the shank 12 is made relatively pointed to permit easy insertion of the anchor rod. The intersection of the conical sections 32 and 34 is radiused along its entire periphery to eliminate the abrupt transition between the upper and lower conical sections to minimize any stress discontinuities occurring at the intersection of the conical sections.

In many instances, it is desirable to provide additional anchoring force to the grout ball 18. This may be accomplished by attaching a pair of enlarged sections **16*a* and 16*b* (FIG. 4) to the threaded end 14 of the shank 12. Preferably, the enlarged section 16*a* should be spaced away from the soil resisting surface of the grout ball 18 by a distance approximately equal to one-third of the height of the grout ball 18. The enlarged section 16*b* should be spaced from the lower surface of the grout ball 18 by a similar distance. For example, when a 30 inch high grout ball is utilized, the enlarged section 16*a* may be spaced approximately 20 inches from the end 28, and the enlarged section 16*b* may be spaced approximately 10 inches from the end 28. For grout balls having other dimensions, the enlarged sections 16*a* and 16*b* would be similarly spaced between the top and bottom of such balls. The use of a threaded section 14 permits the axial position of the enlarged sections 16*a* and 16*b* to be readily adjusted to accommodate grout balls of various size; however, the threaded section 14 may be eliminated and the enlarged sections 16*a* and 16*b* may be fixedly attached to or integrally formed with the shank 12**, particularly if only a single size grout ball is to be used, such as when the chamber is formed by a belling tool.

The angle B between the upper surface **32*a* of the enlarged section 16*a* and the shank 12 is greater than the angle C between the shank 12 and the surface of the upper surface 32*b* of the enlarged section 16*b* to minimize undesirable tensile stresses. The angle B should be in the range of 140° to 160°, preferably 150°. The angle C should be in the range of 110° to 130°, preferably 120°. As in the case of the single enlarged section anchor illustrated in FIGS. 1 and 3, the angles B and C of the enlarged sections 16*a* and 16*b* are dependent on the position of the enlarged sections 16*a* and 16*b* with respect to the grout ball 18; and as in the case of the angle A, the angles B and C are made larger as the respective sections 16*a* and 16*b* are moved upward on the shank 12, and smaller as the sections 16*a* and 16*b* are moved downward on the shank 12**.

The sections 32 and 34 of the enlarged sections, such as the section 16, need not be conical. The lower section 34 need only have a gradually decreasing diameter that decreases along the axis of the shank 12 to be readily inserted into the unhardened grout. The upper section 32 must have a relatively smooth surface positioned such that lines perpendicular to the surface of the upper section 32 and lines perpendicular to the upper surface of the chamber 20 are substantially colinear to minimize curvature of the compressive stress trajectories. The transition between the upper and lower sections 32 and 34 should be gradual to reduce discontinuities and sharp edges that cause stress discontinuities and stress concentrations.

For example, in an alternative embodiment (FIG. 5), an enlarged section 40 has a lower conical section 42 and an upper curved section 44. If the enlarged section 40 were centrally disposed within the grout ball 18, the upper surface 44 would preferably be hemispherical. In such a case, the surface of the section 44 would be substantially perpendicular to radially extending stress trajectories between the section 44 and the upper half of the outer surface of the grout ball, and consequently, the stress trajectories passing between the section 44 and the upper surface of the grout ball will be substantially straight. The curvature of the section 44 would be decreased as the section 40 is lowered with respect to the center line of the grout ball 18, and reshaped as necessary to make lines normal to the surface of the section 44 more nearly parallel to lines normal to the upper surface of the grout ball when the section 40 is raised. The transition between the upper curved section 44 and the lower conical section 42 is gradual and occurs along a radiused perimeter 46.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An earth anchor for anchoring a structure to the earth via a grout ball comprising, an elongated shank having an upper portion and a lower portion, said lower portion including means for anchoring said shank to said grout ball while maintaining relatively straight compressive stress trajectories within said grout ball, said anchoring means including an enlarged section affixed to the lower portion of said shank and means for maintaining said enlarged section spaced substantially away from the periphery of the grout ball, said enlarged section having a continuous nonplanar load bearing surface configured to reduce the undesirable tensile stresses applied to the grout ball.

2. An earth anchor as recited in claim 1 wherein said maintaining means includes means for engaging the earth and supporting said enlarged section in spaced relationship therewith, said supporting means including an elongated member extending coaxially with said shank and extending beyond said enlarged section.

3. An earth anchor as recited in claim 1 wherein said maintaining means includes a threaded end on the lower portion of said shank, and said enlarged section is threadingly affixed to said threaded end, wherein a portion of said threaded end extends beyond said enlarged section and serves to maintain said enlarged section spaced from the earth.

4. An earth anchor as recited in claim 1 wherein said grout ball has a predetermined height and said maintaining means includes means for maintaining one enlarged section substantially centrally located within said grout ball.

5. An earth anchor as recited in claim 4 further including means for adjusting the position of said enlarged section relative to said shank, and making said anchor adaptable to variously sized grout balls.

6. An earth anchor as recited in claim 5 wherein said adjusting means includes a threaded end on the lower portion of said shank, said enlarged section being threadingly affixed to said threaded end and rotatable to adjust the longitudinal position of said enlarged section with respect to said shank.

7. An earth anchor as recited in claim 1 wherein said anchoring means includes a second enlarged section axially spaced from said enlarged section and displaced substantially away from the periphery of the grout ball.

8. An earth anchor as recited in claim 7 wherein said maintaining means includes means for maintaining said enlarged sections positioned within said grout ball with said enlarged sections spaced substantially equidistant from each other and from the periphery of said grout ball.

9. An earth anchor as recited in claim 1 wherein said enlarged section has an upper section that gradually increases in diameter along the longitudinal axis of said shank and a coaxial lower section that gradually decreases in diameter along said longitudinal axis, the largest diameter portions of said upper and lower sections being disposed adjacent to each other.

10. An earth anchor as recited in claim 9 wherein said transition between said upper and lower sections is gradual.

11. An earth anchor as recited in claim 9 wherein said upper section has a curved surface and said lower section is conical.

12. An earth anchor as recited in claim 9 wherein said upper and lower sections are conical sections.

13. An earth anchor as recited in claim 12 wherein said upper conical section has a surface disposed at an angle in the range of 110° to 160° with respect to the longitudinal axis of the upper portion of said shank.

14. An earth anchor as recited in claim 13 wherein the surface of said upper conical section is disposed at an angle of approximately 135° with respect to the longitudinal axis of the upper portion of said shank.

15. An earth anchor as recited in claim 7 wherein said enlarged section is positioned above said second enlarged section, and each of said enlarged sections has an upper section that gradually increases in diameter along the longitudinal axis of said shank.

16. An earth anchor as recited in claim 15 wherein the upper surfaces of said enlarged section and said second enlarged section are conical sections.

17. An earth anchor as recited in claim 16 wherein the upper surface of said conical sections are disposed at an angle in the range of 110° to 160° with respect to the longitudinal axis of the upper portion of said shank.

18. An earth anchor as recited in claim 17 wherein the angle between the surface of the conical section of said enlarged section forms a greater angle with the longitudinal axis of the upper portion of said shank than does the surface of the conical section of the second enlarged section.

19. An earth anchor as recited in claim 18 wherein the surface of the conical section of said enlarged section is disposed at an angle in the range of approximately 140° to 160° with respect to the longitudinal axis of the upper portion of said shank, and the surface of the conical section of said second enlarged section is disposed at an angle in the range of approximately 110° to 130° with respect to the longitudinal axis of the upper portion of said shank.

20. An earth anchor as recited in claim 19 wherein the surface of the conical section of said enlarged section is disposed at an angle of approximately 150° with respect to the longitudinal axis of the upper portion of said shank, and wherein the surface of the conical section of said second enlarged section is disposed at an angle of approximately 120° with respect to the longitudinal axis of the upper portion of said shank.

21. An earth anchor as recited in claim 15 wherein said grout ball has a predetermined height, and wherein said enlarged sections are spaced by a distance approximately equal to one-third of the height of said grout ball from the surface of said grout ball and from each other.

22. An earth anchor as recited in claim 15 wherein each of said enlarged sections has a curved upper surface.

23. An earth anchor as recited in claim 15 wherein each of said enlarged sections has a lower section that gradually decreases in diameter along said longitudinal axis disposed coaxially with said upper section, with the largest diameter portions of the upper and lower sections of each of said enlarged sections being disposed adjacent to each other.

24. An earth anchor for anchoring a structure to the earth via a grout ball having a soil resisting surface, said anchor comprising an elongated shank having an upper portion and an enlarged end configuration adapted for engaging the grout ball, said end configuration having a continuous load bearing surface configured so that lines perpendicular to the upper load bearing surface are substantially colinear with corresponding lines perpendicular to the soil resisting surface of said grout ball.

* * * * *